US008407855B2

(12) United States Patent
Gagnon

(10) Patent No.: US 8,407,855 B2
(45) Date of Patent: Apr. 2, 2013

(54) SUPPORT FOR LAWN FURNITURE LEG

(76) Inventor: Donald F. Gagnon, Candia, NH (US)

( * ) Notice: Subject to any disclaimer, the term of this patent is extended or adjusted under 35 U.S.C. 154(b) by 229 days.

(21) Appl. No.: 12/895,895

(22) Filed: Oct. 1, 2010

(65) Prior Publication Data

US 2012/0079685 A1 Apr. 5, 2012

(51) Int. Cl.
*B60B 33/00* (2006.01)

(52) U.S. Cl. ..... 16/42 R; 248/188.9

(58) Field of Classification Search ..... 16/42 R, 16/42 T, 18 R; 248/188.9, 346.03, 357, 188.8, 248/345.1, 910; 29/428, 525.11
See application file for complete search history.

(56) References Cited

U.S. PATENT DOCUMENTS

| | | | | |
|---|---|---|---|---|
| 2,716,255 | A * | 8/1955 | Laure | 16/42 R |
| 2,736,130 | A | 2/1956 | Boiu | |
| 2,875,552 | A | 3/1959 | Stillman | |
| 3,623,184 | A * | 11/1971 | Mazur | 16/42 R |
| 3,625,462 | A | 12/1971 | Jordan | |
| 3,883,923 | A | 5/1975 | England | |
| 4,200,254 | A | 4/1980 | Nelson | |
| 4,658,521 | A | 4/1987 | Thorpe | |
| 4,915,335 | A | 4/1990 | Miles | |
| 5,141,076 | A | 8/1992 | Joyce et al. | |
| 5,427,342 | A | 6/1995 | Gagnon | |
| 5,513,900 | A * | 5/1996 | Iglesias | 297/463.1 |
| 6,511,127 | B2 * | 1/2003 | Wilkens | 297/270.5 |
| 6,761,340 | B2 * | 7/2004 | Shaw | 248/188.9 |
| 7,000,731 | B2 * | 2/2006 | Swiderski et al. | 182/108 |
| 7,028,808 | B2 * | 4/2006 | Zeaman | 182/108 |

FOREIGN PATENT DOCUMENTS

| | | |
|---|---|---|
| DE | 928600 | 5/1955 |
| GB | 888583 | 1/1962 |

* cited by examiner

*Primary Examiner* — William L. Miller
(74) *Attorney, Agent, or Firm* — ZIP Law PLLC; Claire Zopf

(57) ABSTRACT

A support is provided for positioning on the base of a lawn furniture leg of various shapes and dimensions. The support has an area that is at least five times the area of the bottom of the leg to distribute the load over a large area. This permits easy sliding of the leg across a lawn. The support is arranged to prevent prolonged contact of the leg with a source of moisture. In addition, the support provides venting to the bottom of the leg to minimize dry-rot.

9 Claims, 6 Drawing Sheets

SUPPORT FOR LAWN FURNITURE LEG

FIELD OF THE INVENTION

The present invention is directed to a support for heavy lawn furniture particularly wooden lawn furniture such as cedar redwood chaises, picnic tables and the like. The support attaches to a furniture leg of various shapes and dimensions and provides for ease of movement of the furniture, directing water away from the base of the leg of the furniture preventing mildew and dry rot from forming on a leg and deteriorating the appearance or quality of the furniture.

BACKGROUND OF THE INVENTION

Heavy lawn furniture of wood or plastic composites has become increasingly popular, particularly cedar redwood and the like which can be left outdoors in all types of weather. While such furniture is esthetically attractive it is difficult to move such as when mowing the lawn or when replacing the furniture for reasons of shade, sun or the like. In trying to move such heavy furniture it often requires two people or awkward lifting one end and then the other. It normally cannot be slid across the lawn since the heavy (normally rectangular) legs will dig into the lawn damaging both the lawn and the furniture.

BRIEF SUMMARY OF THE INVENTION

It is a principal object of the present invention to provide a support for such lawn furniture which will provide extended surfaces at the bottom of each leg, which will provide a lower unit pressure on the lawn and which will engage the lawn in such a way that the furniture can be easily slid across the lawn without damaging the lawn. The invention, in a preferred form, comprises a unitary molded element having an area for engaging the surface of the lawn which has an area preferably at least five times greater than the area of the bottom of the leg. This unitary structure preferably has means for supporting the bottom of a variety of leg designs so that most of the bottom of the leg is spaced from the support and prevented from coming in contact with a ground surface such as a lawn to permit easy drying of the bottom of the leg and to prevent dryrot.

A set of upstanding walls are formed on the upper surface of the support with one or more walls having an aperture for insertion of a fastener, screw, bolt or other attachment fitting or device to engage the sides of the leg to secure the support to the furniture leg. Alternatively, a spacer may be inserted in the support and provide accommodation for attachment points for legs of varying shapes and dimensions. A round, square, rectangular or other shaped furniture leg may be secured directly to the support or be secured to the inserted spacer and the support to allow movement of the furniture with the support, the support providing a smooth surface to slide the furniture over a ground surface of grass, concrete, wood or other surface material.

The present invention is directed to a support for engaging the bottom of a lawn furniture leg, the support comprising a unitary molded element having upper and bottom surfaces each with an area at least five times greater than the area of the bottom of the leg; a first upstanding wall in parallel with a second upstanding wall, a third upstanding wall in parallel with a fourth upstanding wall and perpendicular to the first and second walls for engaging the sides of the leg and securing the support to the leg; and wherein the bottom of the leg is spaced above the top surface of the support a sufficient distance to permit drainage of water under the leg whereby to prevent dryrot to the leg.

The present invention is also directed to a support for engaging the bottom of a lawn furniture leg; the support comprising a unitary molded element having upper and bottom surfaces each with an area at least five times greater than the area of the bottom of the leg; a plurality of upstanding walls on the upper surface for engaging the sides of the leg and securing the support to the leg; means for supporting the bottom of the leg so that the leg bottom is spaced above the top surface of the support a sufficient distance to permit drainage of water under the leg whereby to prevent dryrot to the leg.

The present invention is also directed to method for supporting a furniture leg comprising the steps of forming a unitary molded element, the element having an upper and lower surface each with an area at least five time greater that the area of the bottom of the leg; forming a first upstanding wall in parallel with a second upstanding wall on the molded element; forming a third upstanding wall in parallel with a fourth upstanding wall on the molded element, the third and fourth walls perpendicular to and at a distance closer than the distance between the first and second walls; securing a furniture leg between one of at least the first and second and third and fourth walls; and supporting the leg above the upper surface of the molded element to permit drainage of water under the leg whereby to prevent dryrot.

These and other features, advantages and improvements according to this invention will be better understood by reference to the following detailed description and accompanying drawings.

BRIEF DESCRIPTION OF THE DRAWINGS

The above-mentioned and other features and advantages of this invention, and the manner of attaining them, will become more apparent and the invention will be better understood by reference to the following description of an embodiment of the invention taken in conjunction with the accompanying drawings, wherein.

DETAILED DESCRIPTION OF THE INVENTION

Figure 1:
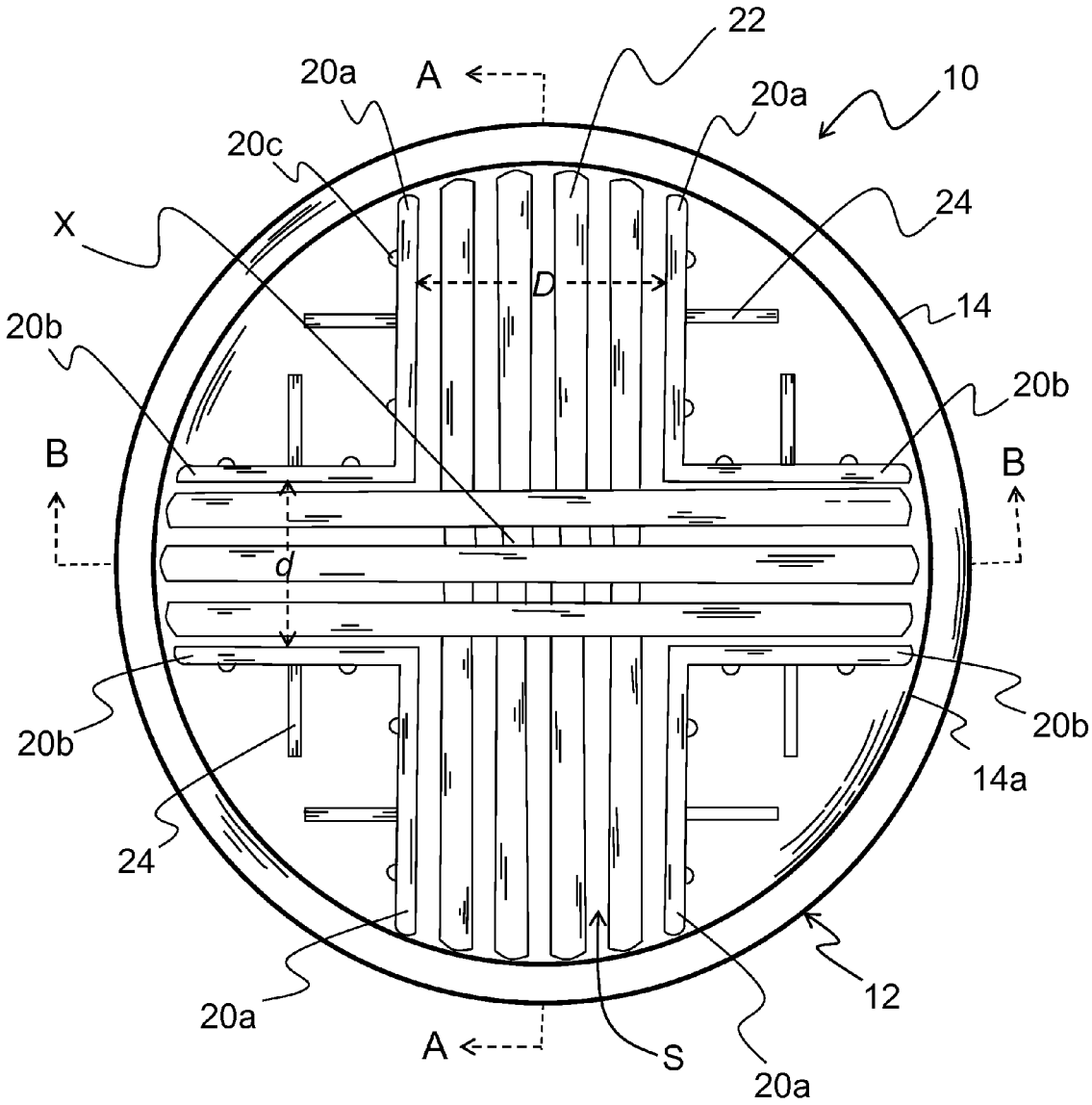
FIG. 1 is a diagramatic schematic top view of a preferred embodiment of support of the present invention.

Referring to FIG. 1, the support or lawn coaster which is generally shown as 10 comprises a unitary molded structure 12 having a circular edge 14. As seen best in FIG. 2A and 2B, the support 12 has a bottom surface 16 and an upper surface 18. In a first embodiment, the upper surface 18 supports a set of engaging walls 20 to align a furniture leg 21 of wood or plastic composite within the engaging walls 20. The engaging walls 20 are aligned along axis A and form a cross with a first dimension D between a first set of engaging walls 20*a* of a longer length than the distance between a second set of engaging walls 20*b* aligned along axis B. The second set of engaging walls 20*b* having a shorter distance between them as denoted by the second dimension d in FIG. 1. The furniture leg shown at 21 in FIGS. 2A and 2B as dotted lines may be of various dimensions in width with the first set of engaging walls 20*a* accommodating a furniture leg 21 of a wider width of between 1¼ inches and 1½ inches. The second set of engaging walls 20*b* may accommodate a narrower width of furniture leg of between ¾ inches and 1 inch. The furniture leg is placed between the appropriate first or second set of engaging walls that accommodates the dimensions of the furniture leg, the leg may then extend through the cross area X of the support 12.

The engaging walls 20 may be on the order of 3/16 inches in width and 1 inch to 1½ inches in height and may be supported by one or more structural braces 24 to provide rigidity to the wall and maintain the wall in an upright position. The braces 24 may be arranged perpendicularly to the engaging wall 20 as shown in FIG. 1 or may be affixed to the support 12 at an acute angle to the wall 20. In providing additional strength to the upstanding wall 20, the braces 24 transmit lateral motion from the furniture leg 21 to the element 12 when it is to be slid across the ground. It is to be appreciated that the braces may not be necessary in view of the molded nature of the integral engaging walls 20*a*-20*b* being integrally connected at about ninety degrees providing inherent support to such walls.

As can be seen, the bottom of the furniture leg 21 is supported by ribs 22 provided on the upper surface 18 between each of the first and second sets of securing members 20 so that there is a space between leg 21 and upper surface 18. The supporting ribs 22 may be at a distance of between 1/32 inches and ⅛ inches between each rib to adequately support furniture legs of various dimensions that are inserted between each of the engaging walls 20. The ribs 22 are contoured to create a slant from the cross area X down to the circular edge 14 of the support 12. The spaces S formed between the ribs 22, provides ventilation to the furniture leg 21 to disperse water from rain or dew thereby controlling and minimizing dry-rot.

Figure 2A:
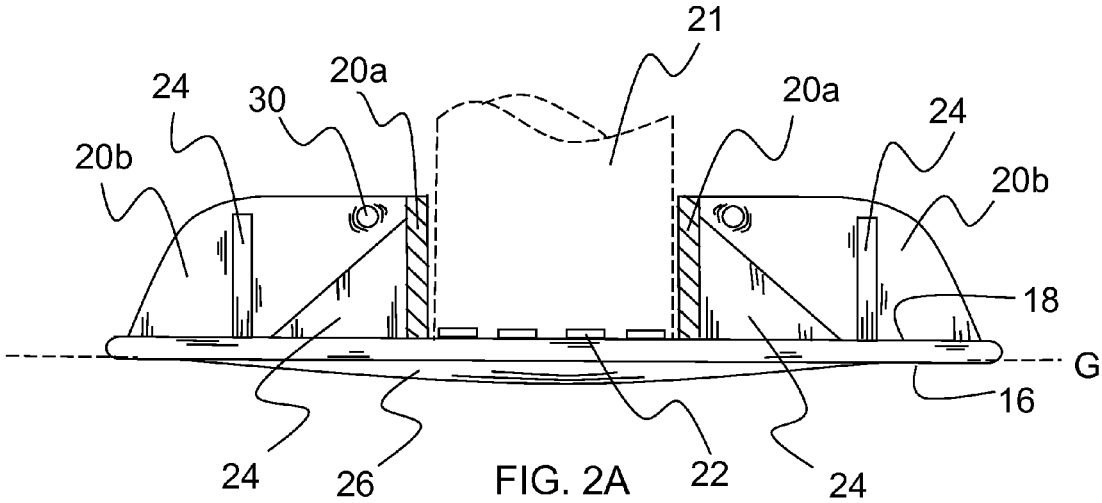
FIG. 2A is a diagramatic schematic sectional view along the line A-A of FIG. 1 showing various features of the support of the present invention.
Figure 2B:
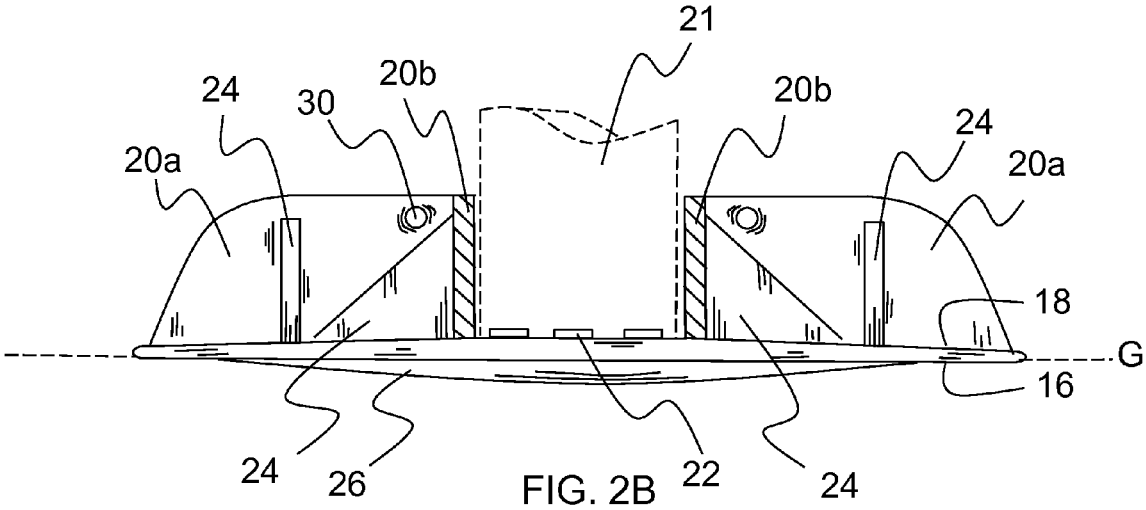
FIG. 2B is a diagramatic schematic sectional view along the line B-B of FIG. 1 showing various features of the support of the present invention.

As shown particularly in FIGS. 2A and 2B the interior 26 of the bottom surface 16 is slightly concave to assist in maneuvering a heavy piece of furniture across an irregular surface, each of the legs 21 of the furniture having a support 12. This is an important aspect so that the edge defined by the perimeter 14 does not catch on the ground. Similarly, the upper surface 18 adjacent the rounded perimeter 14 may be slightly concave as indicated at 14*a* to facilitate molding of the product as shown in FIG. 2A or have an angular slant 15 as shown in FIG. 2B. The perimeter 14*a* of the bottom surface also has upturned peripheral edges to assist in gliding of the support 12 over a ground surface G.

As seen in FIG. 2A the upper surface 18 has a slightly angular slant 28 to provide drainage so that any rain water hitting the element is drained towards the perimeter 14 and away from the bottom of the furniture leg 21 which is supported at the center of the element 12.

As a result of the above described construction the element 12 provides a support which has a relatively smooth surface which distributes the load of the furniture over a large area and provides a smooth surface which can be readily slid across the surface of the ground. Thus, the furniture can be readily moved from place to place so as to reposition the furniture for whatever reason, such as mowing the lawn or to move it in or out of shade, as desired.

Figure 3:
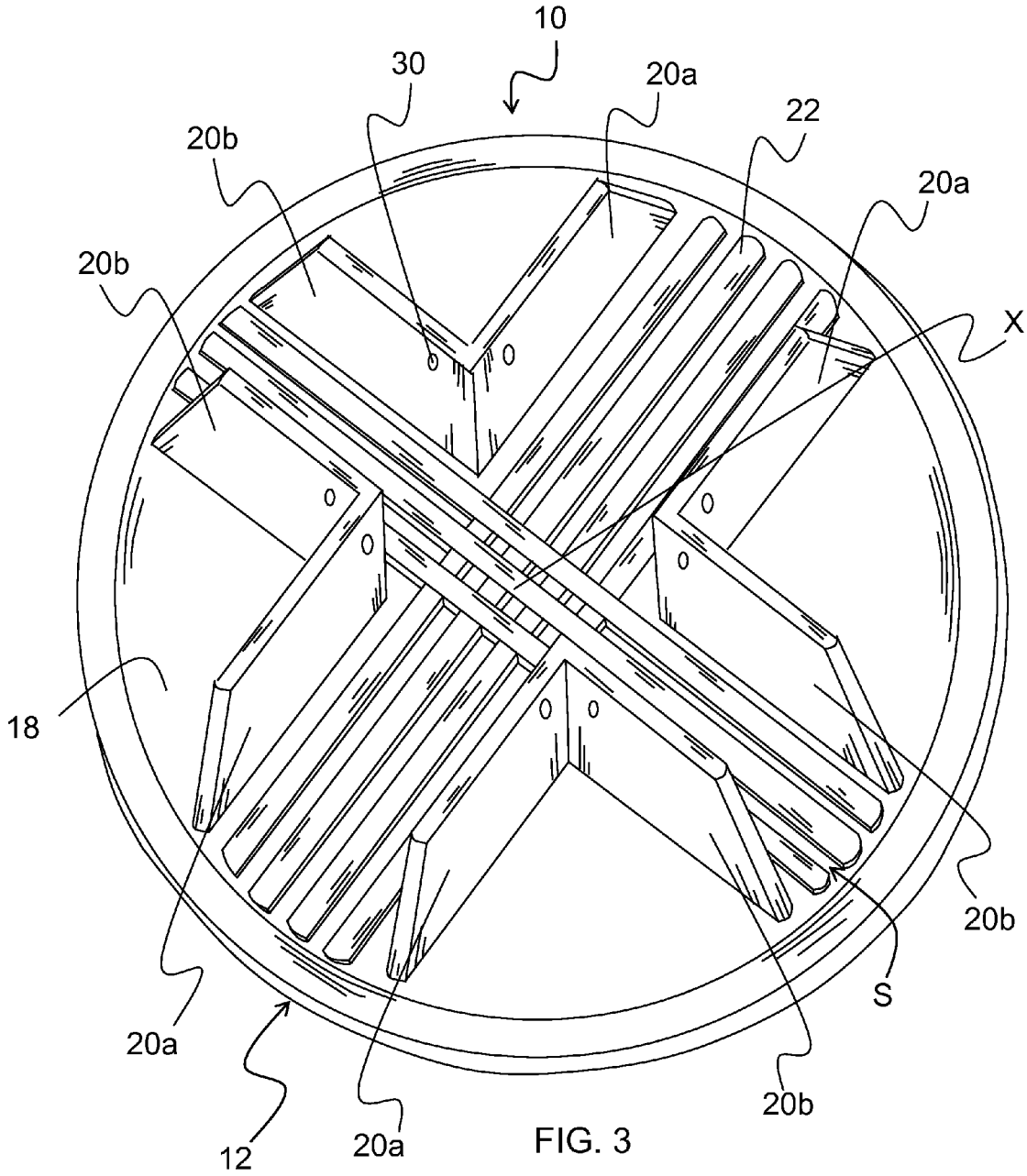
FIG. 3 is a diagramatic perspective view of the preferred embodiment of the support of the present invention.

In a preferred embodiment of the invention the product is molded of a plastic material such as low density polyethylene, or polypropylene. In one preferred form the support 12 is on the order of 7⅝ inches in diameter and has a thickness on the order of 5/32 inches. It can be attached to the bottom of the furniture leg by means of screws, pins or other attachments (not shown) which pass through an aperture 30 in the wall 20. The spacing between the first set of engaging walls 20 is preferably about 2 inches and the walls 20 are slightly tapered outwardly to permit easy attachment to the bottom of the furniture leg 21. The spacing between the second set of engaging walls 20 is preferably about 1 9/16 inches Ribs 22 also reinforce the central portion 26 of the support 10. Molding sprues 20*c* may also be formed to reinforce the upstanding walls 20. As shown in FIG. 3, the engaging walls 20 create a slot for the insertion of a furniture leg 21. The dimensional width of the leg should 21 fit snugly between the chosen set of engaging walls 20 and allow for the insertion of a pin or screw through the aperture 30 and a hole drilled or formed in the furniture leg 21. A separate pin or screw may be inserted from each side of the furniture leg 21 or the hole may be formed completely through the leg 21 and a bolt and nut inserted through the walls 20 and leg 21 may be used to secure the support 12. Other optional methods of attachment are contemplated. The leg 21 may extend through the cross area X to allow the leg 21 to also be secured through the corresponding set of engaging walls 20 on the other side of the support 12.

Figure 4:
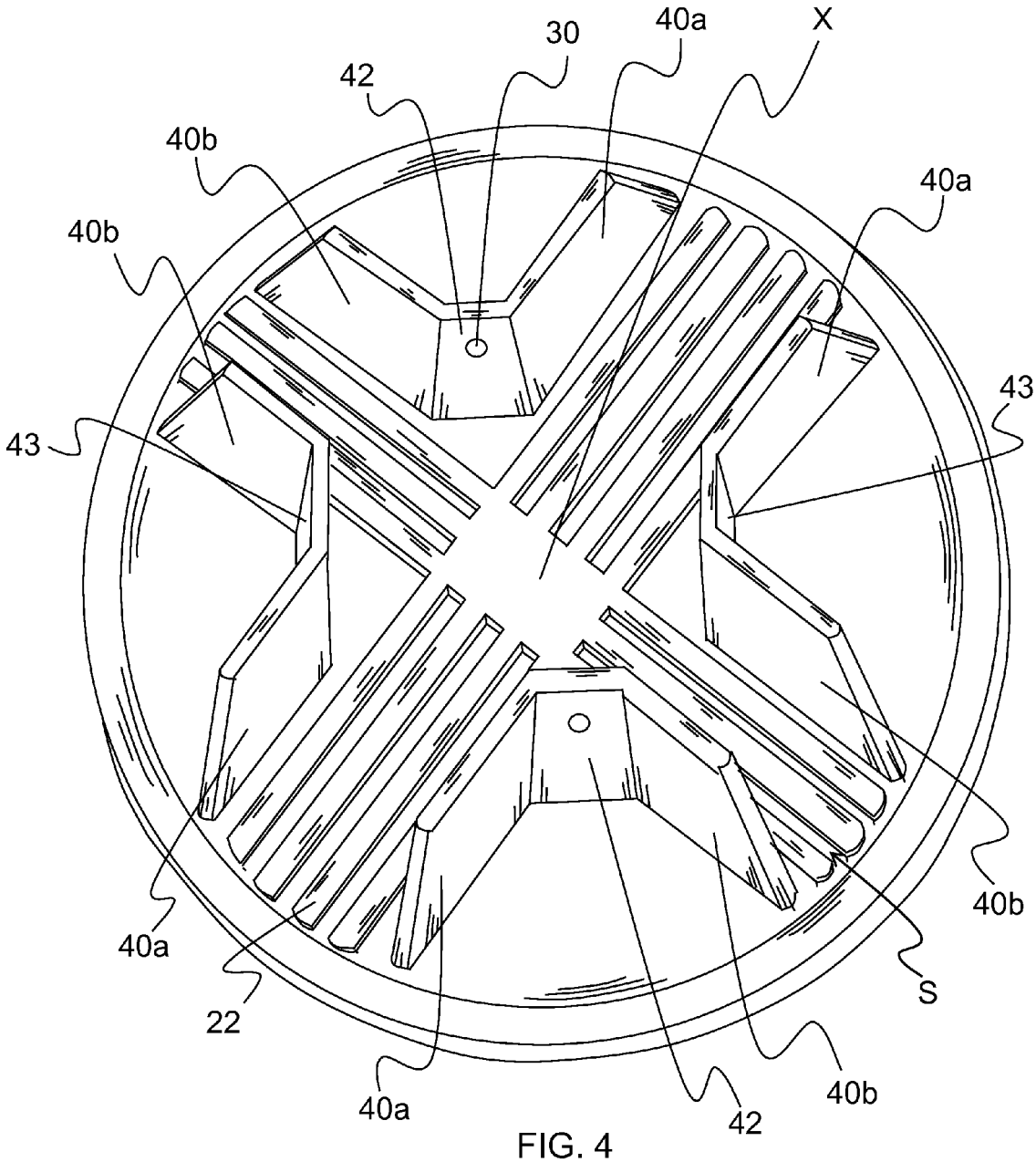
FIG. 4 is a diagramatic perspective view of a further embodiment of the support of the present invention.

In a further embodiment shown in FIG. 4, a support 11 has engaging walls 40 that are formed with a first mid-portion 42 of a shorter length and a second mid-portion 43 of a longer length, the mid-portions facilitating the insertion of a spacer 44 shown in FIGS. 5A-5E. The engaging walls 40 are formed in similar dimensions to the first and second set of walls described above with a dimension D between the first set of engaging walls 40*a* longer than the dimension d between the second set of engaging walls 40*b*. Braces to support the walls 40 and slanted ribs 22 with spacing S may be formed in the support 13 as described above to provide ventilation to the furniture leg 21 and minimize dry rot.

Figure 5A:
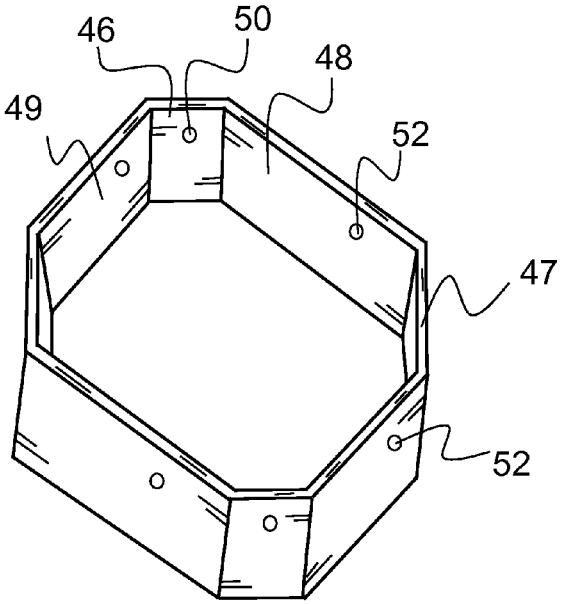
FIG. 5A is a diagramatic perspective view of a spacer for the further embodiment of the present invention.
Figure 5B:
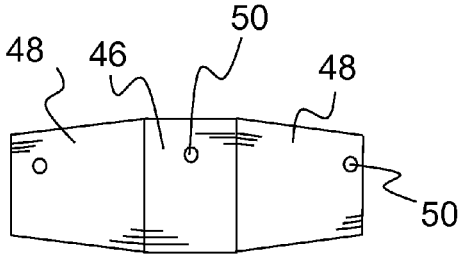
FIGS. 5B and 5C are a diagramatic schematic of first and second side views of the spacer for the further embodiment of the present invention.
Figure 5C:
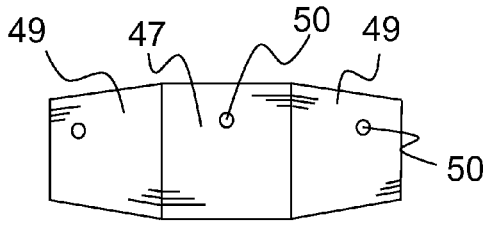
Figure 5D:
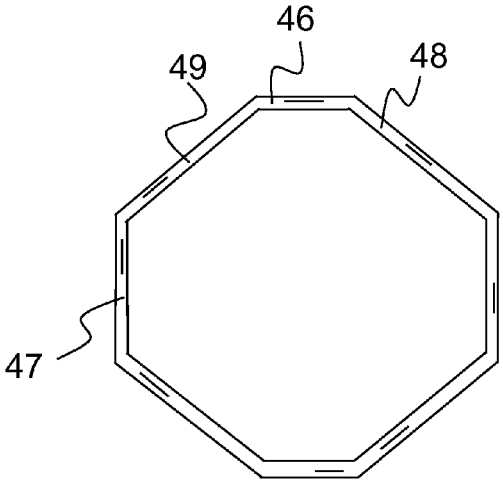
FIG. 5D is a diagramatic schematic top view of the spacer for the further embodiment of the present invention.
Figure 5E:
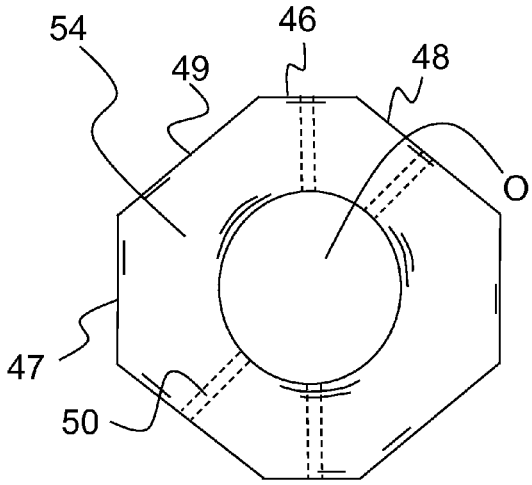
FIG. 5E is a diagramatic schematic top view of a further embodiment of the spacer with a rounded interior for the further embodiment of the present invention.

As shown in FIGS. 5A-5E, the spacer 44 is molded of a rigid plastic material such as low density polyethylene, or polypropylene. The spacer 44 is formed with a first narrower side 46 to complement the dimensions of the first mid portion 42 of the engaging walls 40 and a second longer side 47 to complement the second mid-portion 43 of the wall. The remaining sides of the spacer are at a length that complements the distance between the first set of engaging walls 40*a* D and the second set of engaging walls 40*b* d with a first longer side 48 at length D and a second shorter side 49 at length d. Side views and a top view of the spacer are shown in FIGS. 5B-5E respectfully. One or more of the mid-portion sides 46, 47 of the spacer 44 may have an aperture 50 for insertion of a pin or screw (not shown) to attach the support 11 and spacer 44 to a furniture leg 21. Alternatively, one of the longer or shorter sides 48 and 49 of the spacer 44 may also have an aperture that provides for the spacer 44 to be attached to a furniture leg 21 and the support 11 to be attached to the spacer 44 at one of the mid-portion apertures 50. In a further embodiment as shown in FIG. 5E, the spacer may have a rounded interior portion 54 to accommodate round furniture legs of smaller dimensions. Other shapes for the interior portion are contemplated, such as oval or rectangular. One or more apertures 50 may be drilled through one or more sides of the round or other shaped interior portion to attach the support to a furniture leg of different shapes and dimensions.

Figure 6:
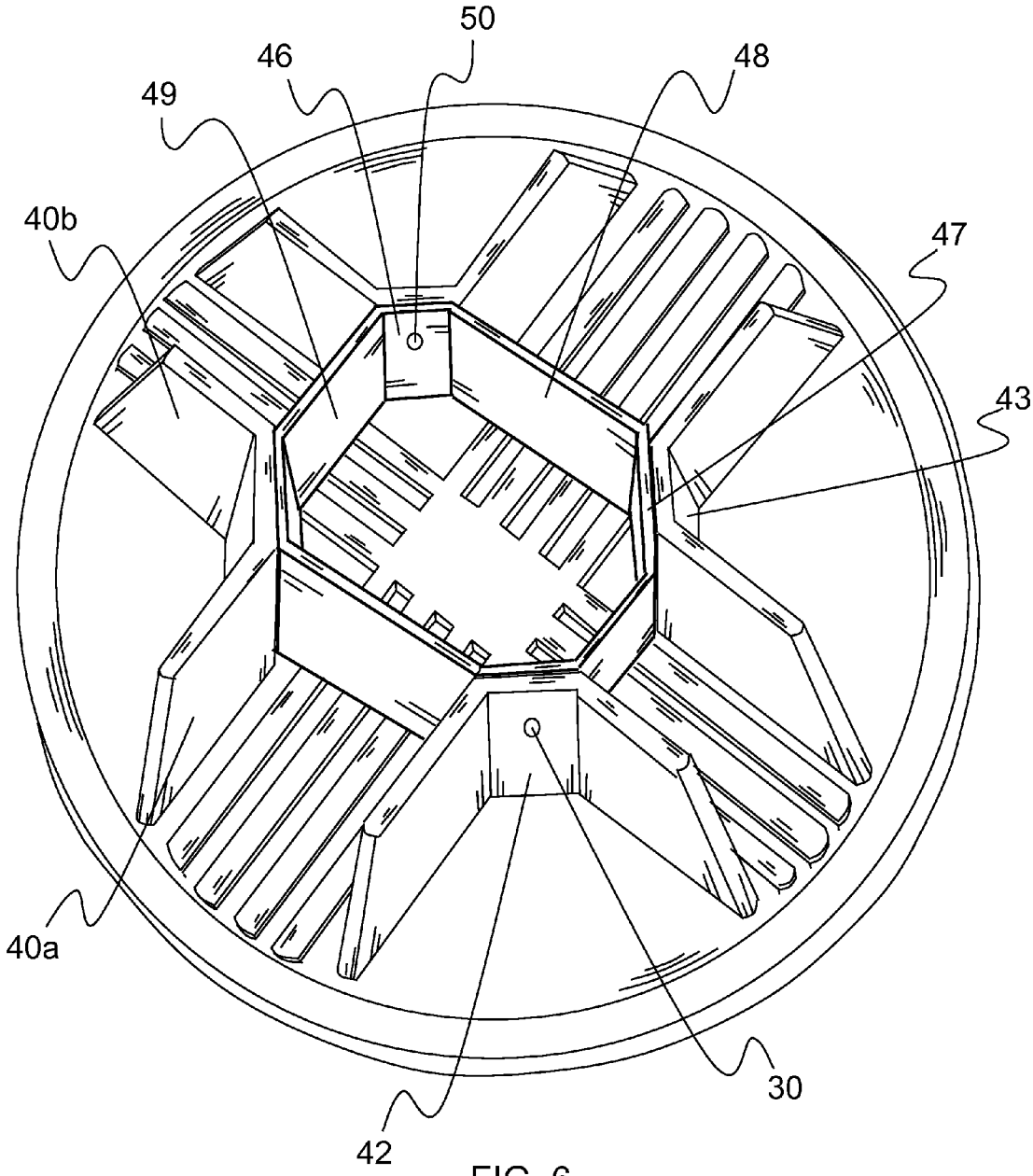
FIG. 6 is diagramatic view of a perspective view of the further embodiment of the support of FIG. 4 and the insert of FIG. 5A-5D.

As shown in FIG. 6, the spacer 44 fits snugly within the engaging walls 40 to secure an oval or round shaped furniture leg 21 within the spacer. An aperture through each of the mid-portions 42, 43 of the support engaging walls provides for the insertion of a pin, screw or other attachment fitting to secure the circular or oval leg to the support. The walls of the spacer may be of a dimension similar to the engaging walls or may be thicker with the interior shaped in a rounded curve as shown in FIG. 5E. It is also to be appreciated that the mid-portions 42, 43 do not have to be linear, but may also be rounded to accommodate a rounded furniture leg within the engaging walls 40, with or without a spacer as described above.

The invention has been described in detail with particular reference to certain preferred embodiments thereof, but it will be understood that variations and modifications can be effected within the spirit and scope of the invention.

I claim:

1. A support for engaging the bottom of a lawn furniture leg;

the support comprising a unitary molded element having upper and bottom surfaces each with an area at least five times greater than the area of the bottom of the leg;

a plurality of upstanding walls on the upper surface for engaging the sides of the leg and securing the support to the leg;

means for supporting the bottom of the leg so that the leg bottom is spaced above the top surface of the support a sufficient distance to permit drainage of water under the leg whereby to prevent dryrot to the leg; and wherein the plurality of upstanding walls forms a cross, the cross having a first dimension between a first pair of the plurality of upstanding walls greater than a second dimension between a second pair of the plurality of upstanding walls and a spacer is inserted within the cross to provide for attachment of a circular said leg.

2. The support of claim 1, wherein the element is circular.

3. The support of claim 1 wherein the central portion of the bottom surface of the support is slightly concave.

4. The support of claim 1 wherein the upper surface is slightly tapered from a central portion to an edge of the element.

5. The support of claim 4, wherein the edge is rounded to permit sliding across a lawn.

6. The support of claim 1, wherein strengthening ribs are provided adjacent the outside surface of the plurality of upstanding walls.

7. A method for supporting a furniture leg comprising the steps of;

forming a unitary molded element, the element having an upper and lower surface each with an area at least five time greater that the area of the bottom of the leg;

forming a first upstanding wall in parallel with a second upstanding wall on the molded element;

forming a third upstanding wall in parallel with a fourth upstanding wall on the molded element, the third and fourth walls perpendicular to and at a distance closer than the distance between the first and second walls;

securing the furniture leg between one of at least the first and second and third and fourth walls; and supporting the leg on a rib at a point higher than the surface of the molded element above the upper surface of the molded element to permit drainage of water under the leg whereby to prevent dryrot.

8. The method for supporting a furniture leg as set forth in claim 7 further comprising the step of forming an aperture in one or more of the upstanding walls for insertion of a screw to secure the leg to the support.

9. The method for supporting a furniture leg as set forth in claim 7 further comprising the step of inserting a spacer between each of the upstanding walls to secure a circular said leg to the support.

* * * * *